United States Patent [19]

Reinitz et al.

[11] 4,219,969

[45] Sep. 2, 1980

[54] PIVOTING BREAKAWAY COUPLING SYSTEM

[75] Inventors: Willard O. Reinitz; Leland G. Phillips, both of Louisville, Ky.

[73] Assignee: Safetran Systems Corporation, Louisville, Ky.

[21] Appl. No.: 942,365

[22] Filed: Sep. 14, 1978

[51] Int. Cl.[2] ..... E05C 15/02

[52] U.S. Cl. ..... 49/141

[58] Field of Search ..... 49/141, 192, 334, 140

[56] References Cited

U.S. PATENT DOCUMENTS

| | | | |
|---|---|---|---|
| 3,394,498 | 7/1968 | Reinitz et al. | 49/141 |
| 4,090,685 | 5/1978 | Pappas | 49/140 X |

*Primary Examiner*—Kenneth Downey

*Attorney, Agent, or Firm*—Mattern, Ware, Davis & Stoltz

[57] ABSTRACT

By securely holding a gate arm connected pivot bar in a retaining and supporting assembly which supportingly holds the pivot bar in one position and allows the pivot bar to drop free when the bar has arcuately rotated into a second position, a universally applicable, pivoting breakaway coupling system is achieved which assures controlled, repeatable, impact breakaway of a roadway crossing gate arm from the control system. The universally applicable, breakaway coupling system of the present invention incorporates a crossing gate arm having a breakaway adapter securely mounted to one end thereof, with the breakaway adapter incorporating a pivot bar which is quickly and easily securely positioned in the retaining assembly for secure, supporting retention thereon when in a first position. Also, the breakaway coupling system preferably incorporates a pivot pin, about which the pivot bar rotates, and two support ledges, aligned with each other and lying in a plane substantially perpendicular to the central axis of the pivot pin, thereby assuring supporting retention of the gate arm in its first position, and complete disconnection when rotated into a second position.

12 Claims, 8 Drawing Figures

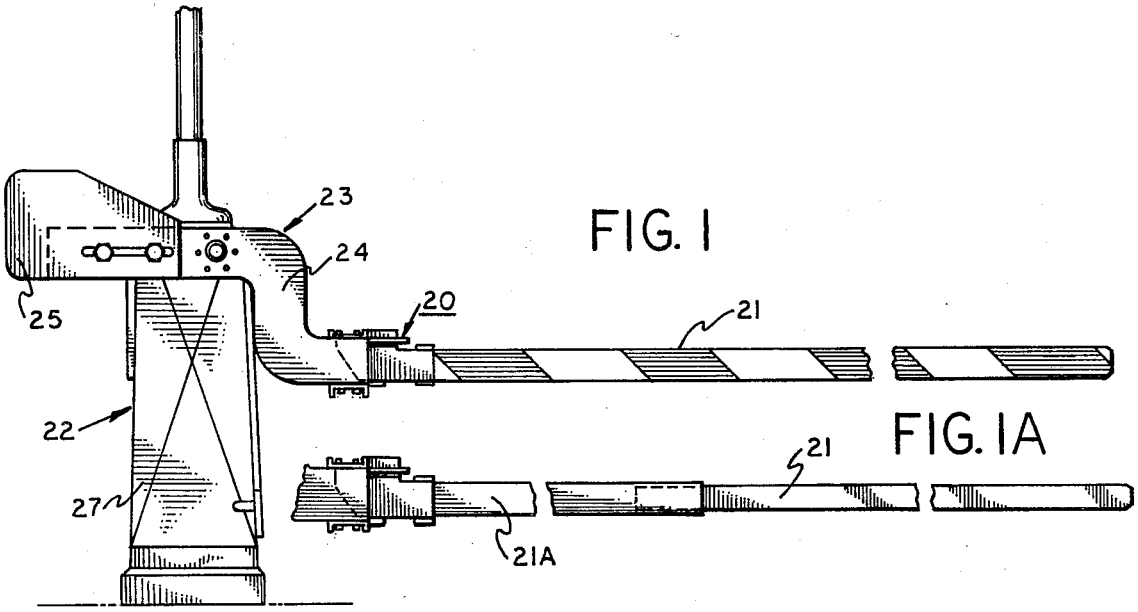
FIG. 1
FIG. 1A
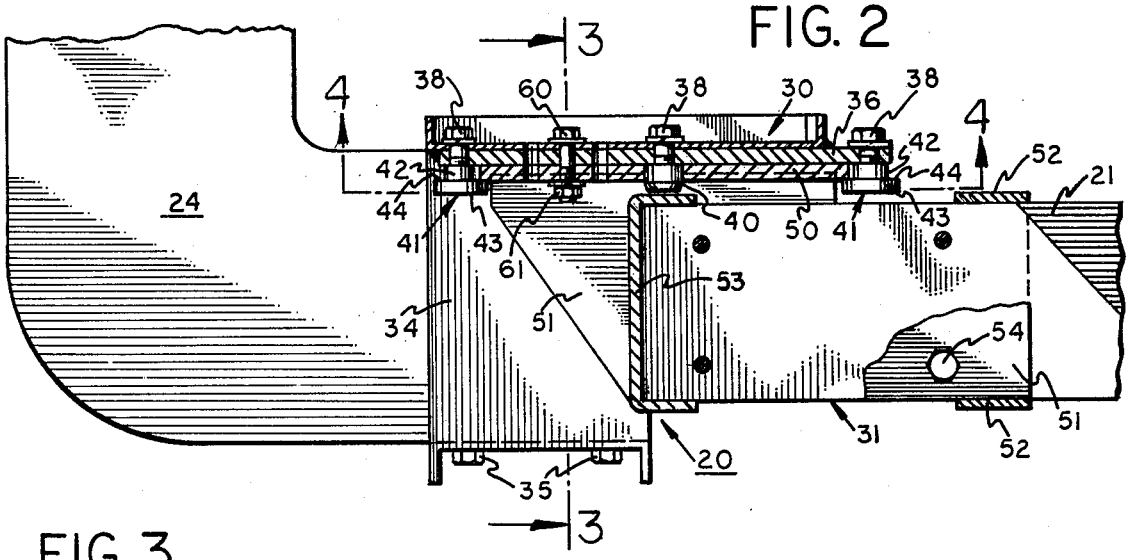
FIG. 2
FIG. 3
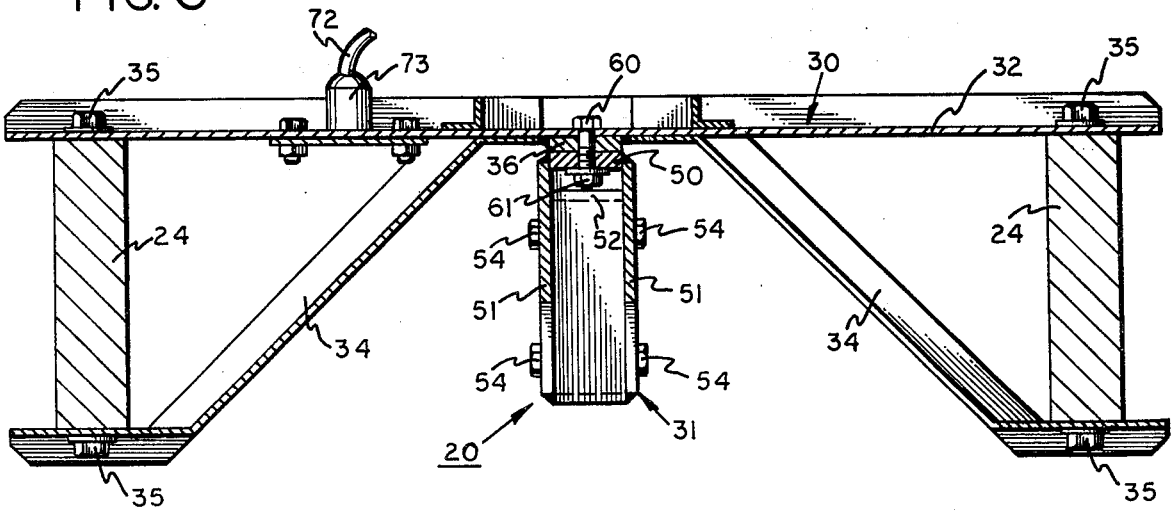

50
57
51
41
50
60
45
40
41
45
61
56
36
57
51
50
30
32

24
33
35
33
24
30
38
60
38
32
34
35
33
51
52
53
54
50
54
20
51
31
34
33
21

PIVOTING BREAKAWAY COUPLING SYSTEM

TECHNICAL FIELD

This invention relates to traffic control devices and more particularly to breakaway coupling for use on movable gate arms on railroad crossings and other traffic control points.

BACKGROUND ART

Controllable crossing gate arms have long been employed in various situations where a physical barrier is required to prevent traffic flow, during one condition, while also being capable of pivoting out of the path of the traffic flow in response to a command signal to allow the traffic to move freely when a barrier is not required. Typically, crossing gate arms are employed along roadways which cross railroad lines, as well as at highway toll booths in order to prevent passage of an automobile without payment of the desired toll.

Until the mid 1960's, crossing gate arms were found primarily at railway grade crossings and were typically constructed of heavy wood or metal which required heavy-duty lifting mechanisms as well as large counterweights to balance the weight of the heavy crossing gate arm. Furthermore, these crossing gates were severely damaged or destroyed if struck by a highway vehicle when the crossing gate was in the blocking position. In 1964, the railway industry recognized that the actuating mechanism for crossing gates at railway intersections could be protected from collision damage if a breakaway connector were used between the gate arm and the actuating mechanism. However, no feasible breakaway structure was proposed.

Subsequently, this long felt need was satisfied for the first time with the breakaway system and lightweight crossing gate arm invented by myself and Harry A. Scott. Our invention was granted U.S. Pat. No. 3,394,498 on July 30, 1968. Although several other prior patents are cited in our patent, we discovered and perfected the first practical, reliable breakaway gate arm construction of which I am aware. Furthermore, I am not aware of any other prior issued patents wherein a controlled breakaway structure for a crossing gate arm is disclosed.

Our breakaway structure and lightweight gate arm achieved a controlled breakaway crossing gate arm which was not destroyed by automobile impact, thereby satisfying the long felt need in industry. However, our breakaway structure requires expensive tooling and manufacturing, while also requiring expensive interfitting castings in order to achieve the desired controlled breakaway result.

Furthermore, our previous breakaway construction was directly welded to the supporting yoke of the pivoting mechanism, while also requiring use of additional material to adapt to varying structures of the pivoting mechanisms found in alternative crossing gate structures. Depending upon the problems found with these varying constructions, difficulty was encountered when installing the breakaway structure without the use of skilled or semi-skilled personnel.

In addition, our patented breakaway gate arm construction has a "dropoff" angle of rotation which is about 45°. Although the gate arm has successfully disconnected and fallen to the ground, without crossing the railroad tracks, in many tests and installations, this angle of rotation creates a potential situation in which the gate arm might land in an unfavorable location.

Furthermore, our earlier breakaway construction has the entire weight of the gate arm being supported by the shear bolt. Consequently, extremely heavy gate arms can present a support problem.

As indicated above, I am not aware of any other prior issued patent wherein a controlled breakaway structure for a crossing gate arm is disclosed. However, I am aware of several later products presently being marketed which employ a shear bolt system, similar to my patented breakaway construction, in order to achieve a breakaway gate arm system. However, these particular constructions typically suffer from problems similar to the problems enunciated above in connection with my previously patented breakaway system while also having other difficulties not found in my earlier construction.

In particular, one of the constructions employs a gate arm supporting member which comprises an elongated, substantially U-shaped channel. Upon impact, the gate arm is designed to pivot towards the opened side of the U channel, breaking a shear bolt, and falling to the ground. However, this construction successfully operates only when the gate arm is struck on one specific side. If the gate arm were struck from the other side, the impact force would cause the gate arm to bend about the elongated U channel, snapping along this intersection and being completeley destroyed.

Another problem commonly found in other such constructions is the complete inability of the gate arm to fall to the ground away from the control mechanism, when the gate is in a substantially vertical position and is disconnected by environmental forces. This problem has been noted with breakaway assemblies supporting gate arms in open-ended C-shaped channel supports, such as those described in United States Pat. Nos. 4,067,523 and 4,090,685. Typically, some of these constructions allow the gate arm to only partially drop substantially vertically until they become supported by the system itself. In this way, the dislodgement of the gate arm is unknown to an observer or a casual inspector. A further and more serious disadvantage is the tendency of the dislodged gate arm to slide into a system-jamming configuration when the gate arm is pivoted toward the horizontal position. Typically, the movement of the gate arm mechanism allows the dislodged gate arm to become permanently lodged in the control mechanism, thereby causing jamming or breakage of the mechanism.

The principal object of the present invention is to provide a reliable breakaway coupling system for crossing gate arms which is inexpensive to manufacture and substantially eliminates the necessity for expensive castings.

Another object of the present invention is to provide a breakaway system for crossing gate arms having characteristic features described above, while also being universally installable on both new and old actuating mechanisms with simple installation or retrofit conversion procedures capable of being carried out by unskilled personnel.

Another object of the present invention is to provide a breakaway system for crossing gate arms having the characteristic features described above, wherein the gate arm is supportingly anchored in its normal blocking position during the installation of the breakaway bolts.

A further object of the present invention is to provide a breakaway system for crossing gate arms having the characteristic features described above, whose gate arm is released from the support after rotating through a relatively small angle of rotation, thereby providing a quick release of the arm upon impact.

Another object of the present invention is to provide a breakaway system for crossing gate arms having the characteristic features described above, which is capable of easily supporting the gate arm regardless of its mass or its weight.

A further object of the present invention is to provide a breakaway system for crossing gate arms having the characteristic features described above, incorporating a tubular metal butt section for stiffness with a tubular fiberglass tip section telescoped therein for light weight, Another object of the present invention is to provide a breakaway system for crossing gate arms having the characteristic features described above, which is capable of breakaway operation regardless of the side upon which the gate arm is struck.

A further object of the present invention is to provide a breakaway system for crossing gate arms having the characteristic features described above, which assures the complete dropoff of the gate even in a vertical position, thereby preventing any potential jamming or damage of the pivoting mechanism.

Other and more specific objects will in part be obvious and will in part appear hereinafter.

DISCLOSURE OF THE INVENTION

The controlled breakaway gate system of the present invention eliminates the prior art difficulty of providing a yoke mounting adapter assembly universally installable on the mounting arms of any crossing gate control system, and a breakaway adapter engaging pivot bar assembly which securely holds the gate arm and is pivotally engaged with the yoke mounting adapter assembly and supportingly held in one position. Preferably, the yoke mounting adapter assembly incorporates a pivot pin and supporting flange members which hold the adapter engaging assembly and gate arm in its normal orientation, while also allowing the adapter engaging pivot bar assembly and the gate arm to drop free from the mounting bracket if the pivot bar assembly and gate arm have arcuately rotated between about 15° and 25°.

By employing the breakaway coupling system of this invention, all of the prior art problems are completely eliminated. In particular, almost the entire system is easily manufactured from simple plates and welded assemblies. This eliminates the necessity for castings found in prior art systems, while also assuring a securely engaged structure which supportingly anchors the gate arm in its normal position for secure and complete installation. Furthermore, a positive dropaway structure is provided which assures that the gate arm drops free when the pivot bar arcuately moves through the required distance.

Additionally, the yoke mounting adapter assembly incorporates an integral structure having slot means formed therein in order to assure secure mounting to any yoke arm construction, regardless of its particular size. Furthermore, the system structure provides ease of installation in an obvious and direct fashion, thereby assuring that the installation can be quickly and easily achieved with unskilled personnel on both new installations and retrofit conversions.

The invention accordingly comprises the features of construction, combinations of elements, and arrangements of parts which will be exemplified in the constructions hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which:

FIG. 1 is a front elevation view of a typical crossing gate control incorporating the Breakaway Coupling System of the present invention;

FIG. 1A is a corresponding fragmentary view of a modified composite aluminum and fiberglass gate arm optimally installed therein;

FIG. 2 is partially broken away, and partially in cross-section, showing the Breakaway Coupling System of the present invention;

FIG. 3 is a cross-sectional side elevation view of the Breakaway Coupling System of the present invention, taken along line 3—3 of FIG. 2;

Throughout the several views of the drawings, the same reference numerals are employed to refer to the same elements.

BEST MODE FOR CARRYING OUT THE INVENTION

Figure 4:
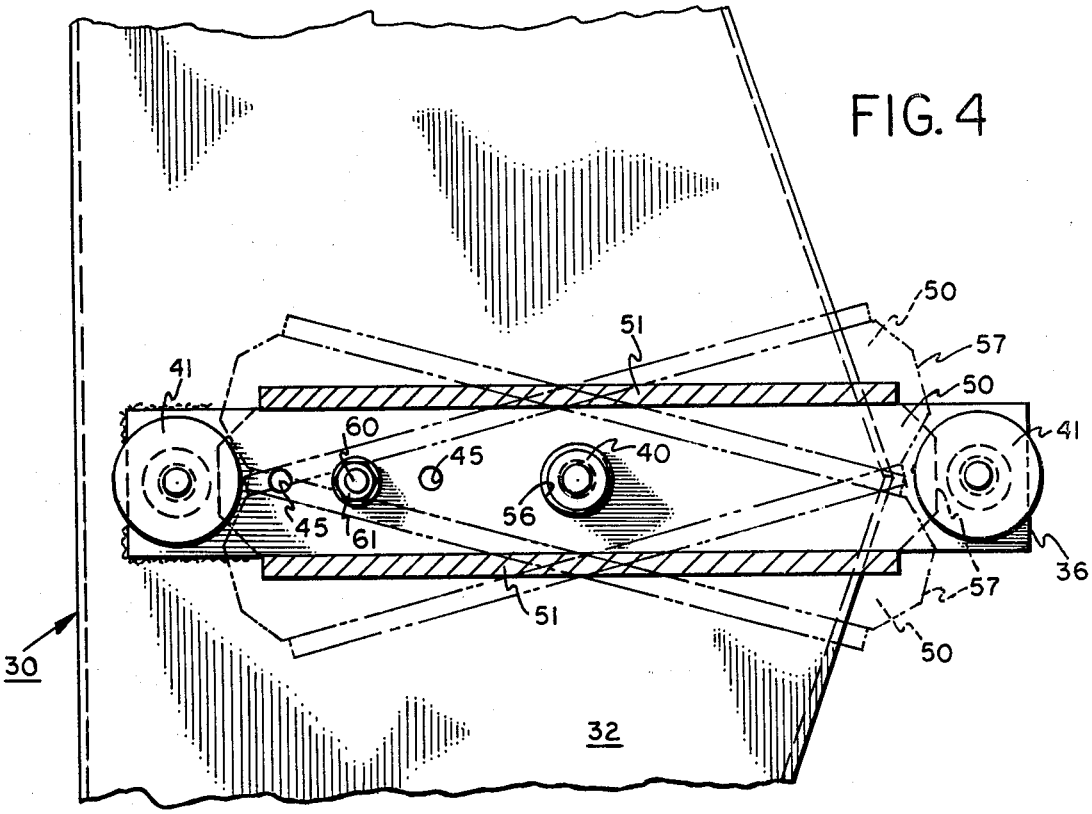
FIG. 4 is a bottom plan view of the Breakaway Coupling System of the present invention, taken along line 4—4 of FIG. 2, and showing alternative pivoted positions in phantom.

In FIG. 1, the pivoting breakaway coupling system 20 of the present invention is shown mounted to a typical railroad crossing gate control assembly 22. As discussed above, pivoting breakaway coupling system 20 can be employed in various other traffic control devices, such as gate arms in toll booths, without in any way departing from the scope of the present invention. However, for exemplary purposes only, pivoting breakaway coupling system 20 is shown and described throughout the remainder of this specification in reference to its applicability and installation on a railroad grade crossing gate control assembly.

As is well known in the art, crossing gate control assembly 22 incorporates a gate arm 21, and a forked yoke 23 having support arms 24. Support arms 24 are pivotally engaged with housing 27, wherein a control mechanism is contained. Also, counterweight means 25 are normally mounted at the opposite end of each support arm 24, to balance the weight of conventional heavy wood gate arms.

When control mechanism 27 receives a first command signal, control mechanism 27 pivots gate arm 21 vertically upward, raising it from the road blocking position, shown in FIG. 1, to an open position wherein the gate arm is substantially vertical to the ground. The use of counterweight 25 at the end of arms 24 assists in counterbalancing the weight of gate arm 21, thereby reducing the rotational force needed for the vertical pivoting action. Then, when a train next approaches, a second command signal is received by the control mechanism in housing 27, causing gate arm 21 to be pivoted vertically downward, lowering it from the substantially vertical position to the horizontal position shown in FIG. 1, effectively blocking the roadway.

As discussed above, many gate arms and actuating mechanisms were completely destroyed by collisions with motor vehicles attempting to cross the railroad tracks when the gate arm is in its horizontal, blocking position or while the gate arm is in the process of moving into its horizontal position. In order to eliminate this costly destruction to the actuating mechanism, as well as reduce the destruction of gate arms, the controlled breakaway system of our previous patent was developed.

In the pivoting breakaway coupling system 20 of the present invention, the problems found in prior art structures are eliminated, while also providing a system capable of quick and easy installation by completely unskilled personnel.

By simultaneously referring to FIGS. 2, 3, 5 and 6, the construction of laterally pivoting breakaway coupling system 20 can best be understood. In general, pivoting breakaway coupling system 20 of the present invention incorporates a yoke mounting adapter assembly 30, which is securely mounted to support arms 24 of crossing gate system 22, and a breakaway adapter engaging pivot bar assembly 31, which is pivotally interconnected with yoke mounting adapter assembly 30 and securely holds one end of gate arm 21.

Yoke Mounting Adapter Assembly

Figure 5:
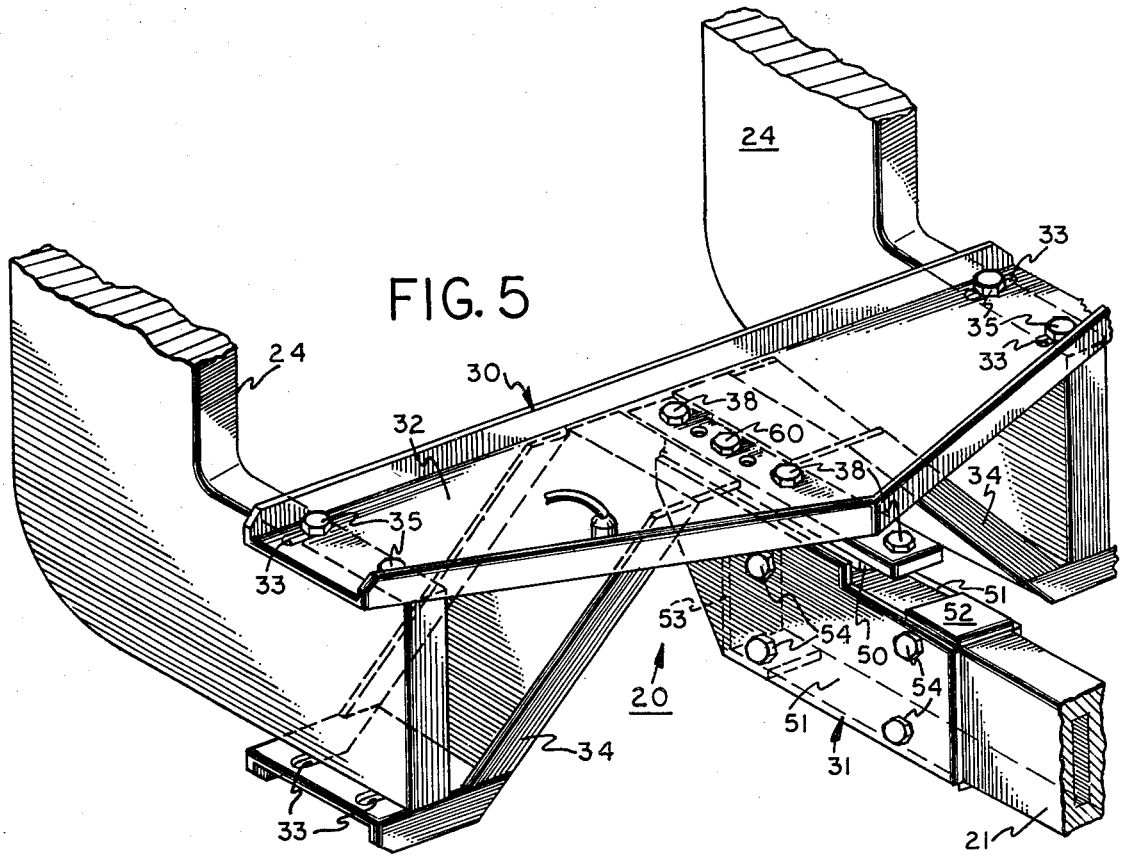
FIG. 5 is a perspective view of the Breakaway Coupling System of the present invention shown mounted in place on the yoke arms of control system.

Yoke mounting adapter assembly 30 incorporates a coupling plate 32, which is constructed to extend between arms 24 for secure mounting engagement thereto. As best seen in FIG. 5, the preferred embodiment of coupling gate 32 incorporates a plurality of elongated slots 33 formed therein for cooperative alignment with mounting holes formed through the sides of arm 24 for secure mounting engagement of coupling plate 32 thereto. Slots 33 accommodate varying existing yoke widths, facilitating their retrofit conversion to breakaway gate arms.

Yoke mounting assembly 30 also incorporates two brackets 34 which are preferably welded at one end thereof to the underside of coupling plate 32. Brackets 34 extend diagonally downwardly, in opposed directions, from their welded junction with plate 32 to a position whereby their opposed terminating ends are in juxtaposed spaced relationship to the terminating ends of plate 32.

Furthermore, each bracket 34 incorporates a supporting platform which is substantially parallel to plate 32 and which incorporates slots 33, cooperatively aligned with slots 33 of plate 32. In this way, bolt means 35 are employed to extend through arm 24 securely supportingly engaging mounting bracket plate 32 and brackets 34 to arms 24 for permanent, secure mounting engagement therewith.

Figure 6:
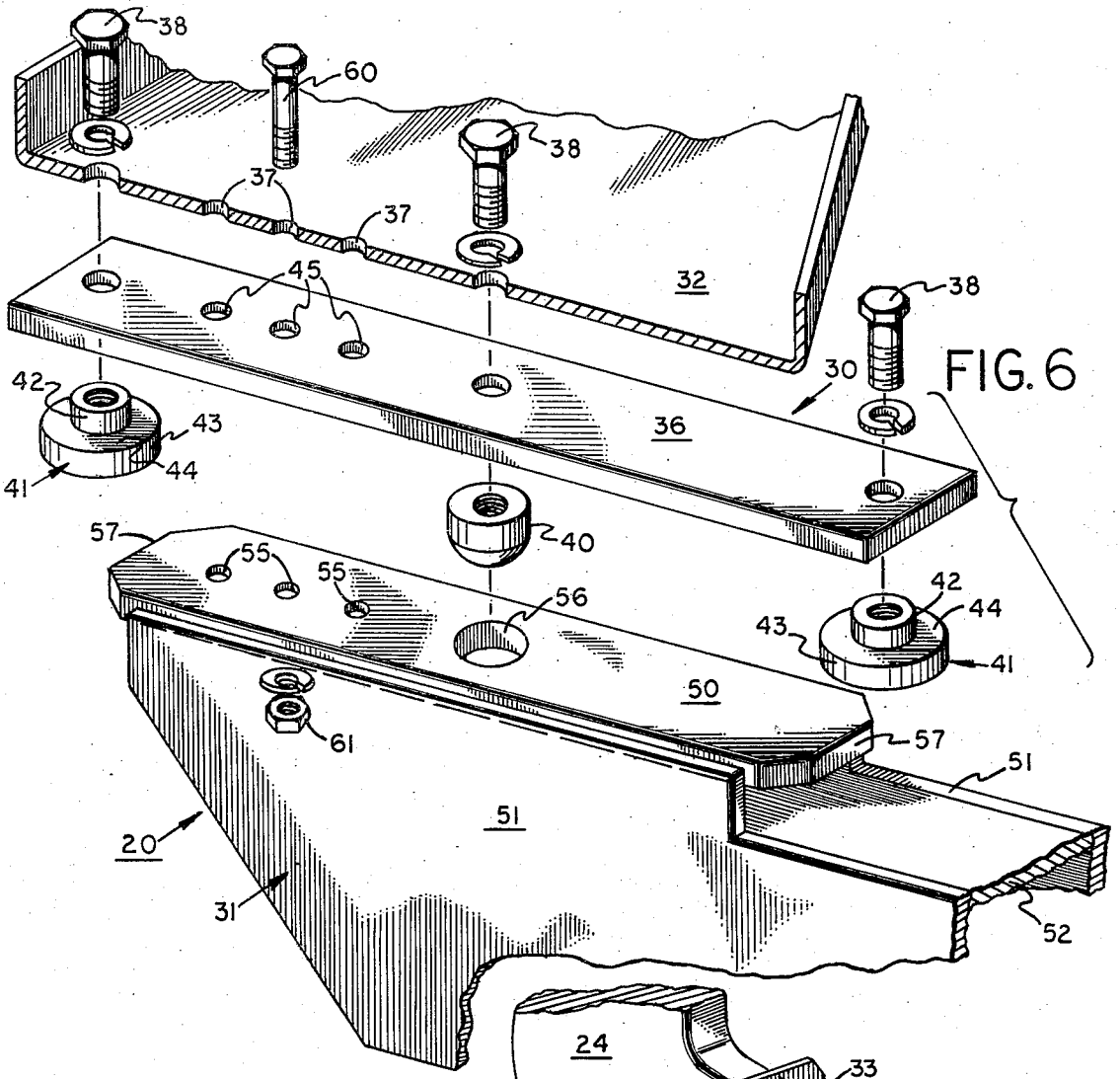
FIG. 6 is an exploded perspective view, partially in cross-section and partially broken away, of the Breakaway Coupling System of the present invention.

Finally, yoke mounting adapter assembly 30 is completed by securely mounting a support bar 36 to coupling plate 32, which supportingly holds the breakaway adapter pivot bar assembly 31 and gate arm 21 in its normal, retained position. As best seen in FIG. 6, coupling plate 32 incorporates a plurality of through apertures 37 and support bar 36 incorporates a plurality of through apertures 45 which are each axially aligned with apertures 37 when support bar 36 is mounted in place to plate 32. Although various alternative constructions could be employed to supportingly hold breakaway adapter pivot bar assembly 31 in position, the preferred embodiment of the present invention employs bolts 38 and stepped nut members 41.

One bolt 38 is positioned substantially at the center of support bar 36, and is threadedly engaged with a nut member 40 having a smoothly tapered or rounded base, in order to function as a hub or pivot pin. Also, since pivot pin 40 is threadedly engaged with bolt means 38, the secure fastening engagement of support bar 36 to coupling plate 32 is provided. If desired, support bar 36 can be welded directly to the underside of coupling plate 32.

The other two bolts 38 are threadedly engaged with stepped nut members 41, at opposed ends of support bar 36, with the bolts 38 and nuts 41 assuring that support bar 36 is further securely engaged with coupling plate 32. Furthermore, stepped nut members 41 each comprise a first section 42 and a second section 43 having a diameter greater than section 42, thereby providing a ledge surface 44. As will be more fully described below, nut members 41, with their ledge surfaces 44 and position at opposed ends of bar 36, provide a support surface for securely, supportingly holding a section of breakaway adapter pivot bar assembly 31.

Breakaway Adapter Pivot Bar Assembly

Breakaway pivot bar assembly 31 comprises a pivot bar 50, two side plates 51, a gate arm end brace 53 and two spacer bars 52, interconnectingly positioned between side plates 51 along a top edge and a bottom edge thereof. In the preferred embodiment, all of the components forming breakaway pivot bar assembly 31 are welded together in order to form a complete adapter engaging assembly which is easily and quickly fabricated and assembled.

In order to securely engage breakaway pivot bar 31 at one end of gate arm 21, a terminating butt end of gate arm 21 is inserted into breakaway adapter assembly 31 between end plates 51 and spacer bars 52. The end of gate arm 21 is inserted axially into breakaway adapter assembly 31 until the terminating end of gate arm 21 securely abuts end brace 53.

Breakaway pivot bar assembly 31 is then affixed to gate arm 21 by bolt means 54. Once breakaway pivot bar assembly 31 has been securely bolted to the end of gate arm 21, breakaway pivot bar assembly 31 and gate arm 21 are ready for secure interconnected engagement with yoke mounting assembly 30.

For extra stiffness, a telescoped tubular gate arm butt section 21*a* of extruded aluminum tubing may form the butt end of gate arm 21 installed in assembly 31. This provides a combined composite gate arm incorporating a stiff metal section carrying maximum bending moment at the butt end, with one or more tubular fiberglass sections telescoped therein forming the lightweight outer end of the gate arm 21, while avoiding metal gate arm tips protruding upward toward contact with overhead power lines when the gate is raised.

As best seen in FIG. 6, pivot bar 50 incorporates a plurality of apertures 55, all of which have substantially identical diameters, and an additional aperture 56 having a diameter substantially greater than apertures 55. Apertures 55 and 56 extend through pivot bar 50, and have central axes which are substantially parallel to each other and lie in substantially the same plane. Furthermore, apertures 55 are positioned for cooperative alignment with apertures 37 of coupling plate 32 and apertures 45 of support bar 36, to receive one or more shear bolts 60.

Breakaway Installation

Breakaway adapter pivot bar assembly 31 and gate arm 21 are installed in pivotable engagement with yoke mounting assembly 30 by moving pivot bar 50 into a position substantially parallel to support bar 36, but angularly skewed relative to the longitudinal axis of support bar 36. Assembly is then quickly and easily completed by (1) simply positioning hub or pivot pin 40 in aligned telescoping engagement with pivot aperture 56 of pivot bar 50, and then (2) arcuately pivoting breakaway pivot bar assembly 31 and gate arm 21 about the axis defined by pivot pin 40 and aperture 56 until the terminating ends 57 of pivot bar 50 are resting upon ledge surfaces 44 of stepped nut members 41. Once breakaway pivot bar assembly 31 and gate arm 21 are positioned in secure, supporting engagement with yoke mounting assembly 30, gate arm 21 extends longitudinally, as shown in FIG. 1, in the desired orientation for providing the traffic control.

The installation of pivoting breakaway connector system 20 is then completed by inserting a shear bolt 60 through at least one of the sets of aligned holes 37, 45 and 55, and securely mounting shear bolt 60 in this position by nut means 61. With shear bolt 60 mounted in position, the assembly of pivoting breakaway coupling system 20 is completed, ready for continuous operation to control traffic flow, when needed, while also being completely controllably separated when gate arm 21 receives a lateral bending force exceeding a predetermined level.

When coupling system 20 is fully assembled, as described above, on gate control system 22, gate control system 22 provides the desired roadway blocking, as well as roadway passage configurations in response to command signals received by system 22. In its typical operation, system 22 maintains gate arm 21 in a substantially vertical orientation until a train-approaching signal is received. Then, system 22 lowers gate arm 21 into a horizontal orientation, blocking the roadway for automobile safety.

During use, various wind forces and environmental pressures impinge upon gate arm 21. Consequently, shear bolt 60 is employed to maintain gate arm 21 in its operational position, securely engaged with yoke mounting assembly 30.

As will be more fully described below in reference to the breakaway pivoting action of breakaway pivot bar assembly 31 and gate arm 21, shear bolt 60 also assures the controlled separation of gate arm 21 and adapter 31 when an extraordinary force is realized. The plurality of sets of aligned apertures formed in coupling system 20 are employed for additional shear bolts, to securely maintain gate arm 21 in the desired position against greater displacement forces, as well as providing alternative locations for a single shear bolt, for varying the particular force displacement required, depending upon particular conditions and gate arm lengths.

Breakaway Operation

During normal use, breakaway coupling system 20 of the present invention operates with gate arm control system 22 in order to maintain gate arm 21 securely engaged with yoke 23 for continuous operation. Specifically, gate arm 21 is pivotally raised upwardly into a substantially vertical position by control system 22, in order to allow cars to freely pass across the railroad tracks. However, when control system 22 receives a signal that a train is approaching, gate arm 21 is lowered into a substantially horizontal position, as shown in FIG. 1, to provide a physical blockade to deter drivers of automobiles from crossing the tracks whenever the danger of an approaching train exists.

As discussed above, it has been found that gate arm 21 is occasionally struck by a moving automobile, for various alternative reasons. However, with the use of coupling system 20, there is assurance that no damage will be imparted to control system 22, while also having positive assurance that gate arm 21 will pivot through a specifically defined arc, and then drop to the ground, normally without serious damage to the automobile or being thrown into the path of the oncoming train. The pivoting release and free dropaway of gate arm 21 can best be seen and understood by referring to FIGS. 4 and 7.

When gate arm 21 is in its normal, securely held, supportingly retained position, pivot bar 50 of breakaway adapter pivot bar assembly 31 is securely supported by ledge-bearing nuts 41 with pivot hole 56 peripherally surrounding pivot pin 40. Furthermore, shear bolt 60 supportingly interconnects yoke mounting assembly 30 with pivot bar 50 of breakaway pivot bar assembly 31.

When gate arm 21 is struck with a lateral force which exceeds a predetermined level, the force impact on gate arm 21 causes pivot bar 50 of breakaway adapter assembly 31 to pivot about the central axis defined by pivot pin 40. However, this pivoting force is resisted by shear bolt 60, since any pivoting motion causes at least one of the apertures 55 of pivot bar 50 to bear directly against the outer peripheral surface of shear bolt 60.

As is well known to one skilled in the art, a shear bolt performs in a manner which will allow the shear bolt to operate in a conventional fastening manner, while also having the inherent physical characteristic of splitting or breaking along a shear plane substantially perpendicular to the central axis of the shear bolt when exposed to shearing forces which exceed a predetermined level. Of course, the shearing force required for a particular bolt varies with the diameter and composition of the particular bolt. However, each bolt is constructed to provide substantially exact, repeatable shearing results in response to exposure to forces exceeding the shear stress limit for that particular bolt.

To those skilled in this art, the force level imposed upon a typical gate arm by wind loads and the various force levels on the gate arm imparted thereto by a moving vehicle are all well known. Using this information, shear bolt 60 is selected to resist the lateral load imparted to gate arm 21 by normal wind forces, while having a shearing threshold which will be exceeded if gate arm 21 were to be struck by a moving vehicle.

As a result of the selection of a shear bolt with the proper force resistant characteristics, the lateral pivoting force imparted to aperture 55 of pivot bar 50 and acting directly against shear bolt 60 causes shear bolt 60 to fracture along a plane substantially perpendicular to the central axis thereof, while the remainder of shear bolt 60 is securely, fixedly retained in nonrotating apertures 37 and 45 of yoke mounting assembly 30. When shear bolt 60 has fractured, pivot bar 50 freely rotates about the pivot axis defined by the pivot pin 40, in response to the lateral force on gate arm 21, until ends 57 of pivot bar 50 have moved out of supporting contact with ledge-bearing nuts 41.

Once shear bolt 60 has been fractured and ends 57 are moved out of supporting containment by ledge-bearing nuts 41, the weight of gate arm 21 and breakaway adapter pivot bar assembly 31 causes the gate arm and adapter pivot bar assembly structure to fall to the ground. As shown in FIG. 4, pivot bar 50 need only move through an arcuate distance of about 17.5° before gate arm 21 and breakaway adapter pivot bar assembly 31 are free to drop to the ground. This small arcuate rotation, which precedes free fall to the ground, normally assures that gate arm 21 will disconnect from yoke mounting assembly 30 and fall to the ground well before gate arm 21 could be pivoted laterally through an arcuate distance which would allow the gate arm to land on the railroad tracks.

In this way, the complete and total destruction of gate arm 21 by smashing contact with or under a moving train is normally eliminated and potential salvage of gate arm 21 without any damage at all is substantially increased. With this construction, most disconnected gate arms can be quickly and easily retrieved intact without any damage for quick and easy reassembly with yoke mounting assembly 30 by merely inserting a new shear bolt. Consequently, any repair or replacement of gate arm 21 or breakaway adapter pivot bar assembly 31 is substantially eliminated, while damage to the delicate mechanism of control gate assembly 22 is completely eliminated.

As should be clearly apparent from the preceding description of breakaway coupling system 20 of the present invention, as well as from a reference to FIG. 4, pivot bar 50 of breakaway adapter pivot bar assembly 31 is free to pivot laterally about its pivot axis in either direction. As a result, the identical construction of coupling system 20 of this invention can be employed on opposite sides of the railroad track without requiring any reversal or variation in the construction or assembly of coupling system 20.

Furthermore, the potential contact of gate arm 21 from either its front surface or its rear surface has no effect on the operation of coupling system 20, which will allow gate arm 21 and breakaway adapter pivot bar assembly 31 to fall freely to the ground regardless of the direction in which pivot bar 50 is caused to move. As a result, the system of this invention is universally applicable to all installations as well as providing universally predictable and repeatable results regardless of the conditions under which the gate arm is caused to be dislodged.

Another feature of coupling system 20 of the present invention is the construction of a gate arm supporting system in which any dislodged gate will fall completely free of the control system, regardless of whether the dislodged gate is in the vertical or horizontal position. In some prior art systems, such as those described in U.S. Pat. Nos. 4,067,523 and 4,090,685, gate arms have become disconnected through the shearing action caused by unexpectedly heavy wind forces acting upon the gate arm. However, since the secured end of the gate arm in these prior art systems is not free to fall to the ground, these prior art gate arms have become telescopingly lodged in the control mechanism or the yoke assembly, allowing an observer to erroneously believe the gate arm is in its secure position.

Furthermore, the retention of these prior art gate arms in a partially supported position has also caused damage to their control systems, since the gate arms can become lodged between moving mechanisms, causing unexpected forces to be placed upon the pivoting control system. This produces either substantial damage to the pivoting mechanism or jamming of the entire mechanism, which is both difficult to repair as well as eliminating the operative mode of the gate arm until such repair is made. As a result, approaching cars are not provided with the proper warning when trains are approaching, thereby providing an extremely unsafe condition for such crossing areas.

As best seen in FIGS. 3 and 5, coupling system 20 of the present invention provides a gate arm supporting and holding system wherein no ledge or shelf members are incorporated behind the terminating end of the gate arm which could potentially support and prevent the gate arm from falling free if the gate arm were dislodged while in the vertical position. With the coupling system of the present invention, any dislodged gate arm whether in the vertical or the horizontal position is free to fall to the ground completely unimpeded by any structural member. As a result, the coupling system of the present invention assures that an observer will readily know whether the gate arm has been dislodged under either automobile forces or wind forces, as well as providing a system which assures the elimination of any potential gate induced jamming or control mechanism failure.

In many gate arm installations, warning illumination means are longitudinally disposed along gate arm 21 in order to enhance the visibility of gate arm 21 for nighttime operation. Specifically, these illumination means are activated when the gate arm is being moved from the vertical position to the horizontal position and then deactivated when the gate arm has returned to its vertical position. As a result, the gate arm illumination means must be connected to a source which must be freely disconnectable in order to assure dropping of the gate arm to the ground when dislodged from yoke mounting assembly 30.

Figure 7:
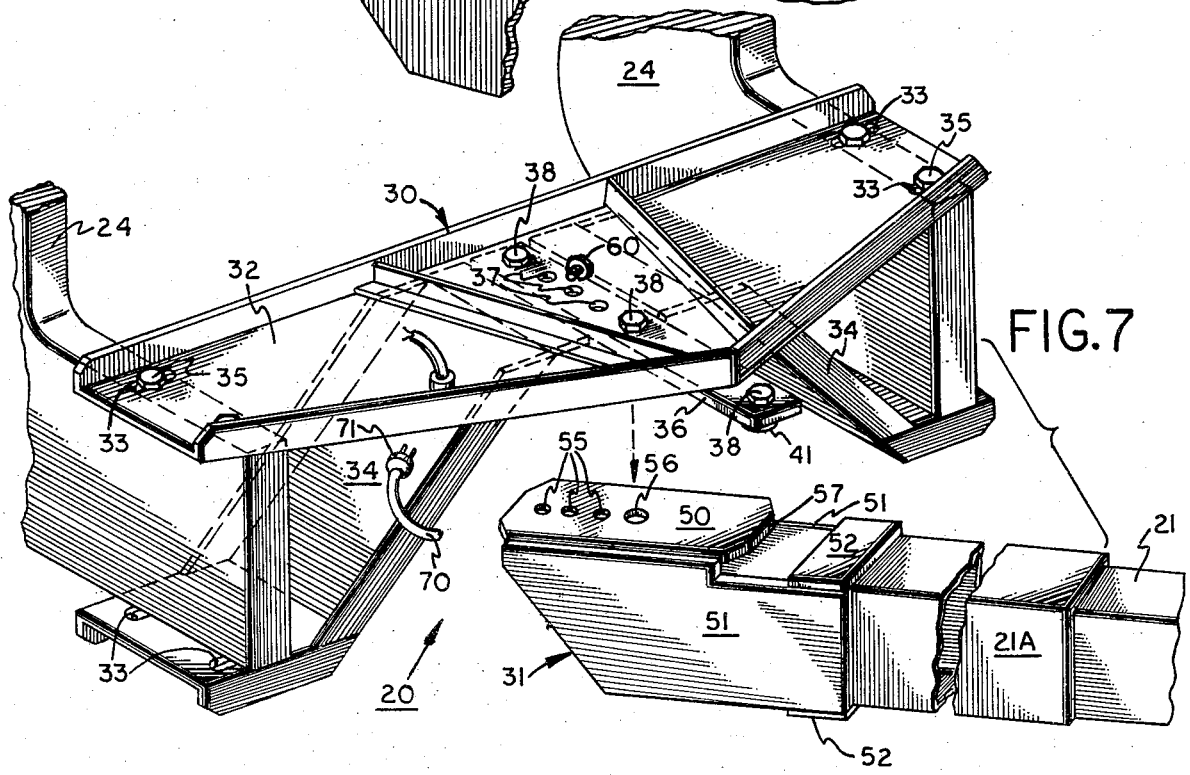
FIG. 7 is a perspective view of the Breakaway Coupling System of the present invention shown in a breakaway mode with the gate arm in the process of falling.

As shown in FIG. 7, gate arm 21 incorporates a power conducting cord 70 having a conventional connector mounted at the terminating end thereof. Cord 70 extends axially along gate arm 21, preferably along the internal cavity formed in gate arm 21. Various illumination means are disposed longitudinally along gate arm 21 and are connected to cord 70.

As shown in FIGS. 3 and 7, yoke mounting assembly 30 incorporates a power receiving cord 72 connected to the control mechanism for powering the illumination means, when so required, with cord 72 electrically connected to a socket member 73 which is securely mounted to plate 32 of yoke mounting assembly 30. As a result, when gate arm 21 and breakaway pivot bar assembly 31 have become dislodged from yoke mounting assembly 30, the weight of gate arm 21 and pivot bar adapter 31 causes plug 71 to be automatically disconnected from socket 73, and to fall to the ground with the gate arm and adapter assembly. In this way, the required illumination means are easily and conveniently powered, while not in any way hampering or interfering with free fall of gate arm 21 and breakaway adapter pivot bar assembly 31 from yoke mounting assembly 30 when a breakaway condition has been experienced.

It will thus be seen that the objects set forth above among those made apparent from the preceding description, are efficiently attained and, since certain changes may be made in the above construction without departing from the scope of the invention, it is intended that all matters contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim is new and desire to secure by letters patent is:

1. A breakaway gate arm coupling system, for mounting to a gate arm control system having a support member which is controllably raised and lowered, said gate arm coupling system comprising:

(A) a mounting adapter assembly securable to the support member of the control system and incorporating
  (a) two supporting shelf portions
    (1) formed on the underside of the mounting assembly,
    (2) lying in substantially the same plane, and
    (3) spaced apart from each other,
  (b) a first pivot-defining member positioned between the two shelf portions,
  (c) at least one, first aperture extending through the mounting assembly;

(B) a breakaway pivot assembly securely mountable to one end of the gate arm and incorporating a pivot bar having
  (a) a second pivot-defining member adapted for cooperative interengagement with the first pivot-defining member for smooth, arcuate sliding engagement therewith,
  (b) at least one second aperture extending through the pivot bar and alignable with the first aperture of the mounting assembly, and
  (c) an overall length dimensioned for secure, supporting engagement with the shelf portions of the mounting assembly at opposed ends of the pivot bar when the first and second pivot-defining members are engaged and said first and second apertures are aligned; and (C) shear bolt means
  (a) positionable through the aligned first and second apertures and securable therein, for fastening the pivot bar to the mounting assembly, and
  (b) having a shear stress limit above which said bolt splits along a shear plane transversely disposed to the central axis of the bolt, and
  (c) responsive to a shear force produced by contact with the second aperture of the pivot bar when the pivot bar attempts to rotate;

whereby the gate arm is securely retained in its normal position during normal use, while being capable of freely dropping from the mounting assembly under breakaway force exceeding a predetermined level which causes the pivot bar to pivot about its pivot axis, shearing the shear bolt, and allowing the pivot bar to become disengaged from the shelf portions of the mounting assembly.

2. The breakaway gate arm coupling system defined in claim 1, wherein the first pivot-defining member is further defined as being positioned along a substantially straight line which extends from one shelf portion to the other shelf portion.

3. The breakaway gate arm coupling system defined in claim 1 or claim 2 wherein the first aperture is further defined as being positioned between one of the shelf portions and the pivot defining member.

4. The breakaway gate arm coupling system defined in claim 1, where the first aperture and the second aperture are both defined as comprising a plurality of apertures with each aperture of the first plurality of apertures being coaxially aligned with one aperture of the second plurality of apertures.

5. The breakaway gate arm coupling system defined in claim 1, wherein each of the shelf portions are formed on a threaded, ledged, collar member securely engaged with the mounting assembly by bolt means and incorporating a first diameter portion and a second diameter portion greater than the first diameter portion, providing the pivot bar supporting shelf portion on the surface of the enlarged second diameter portion.

6. The breakaway gate arm coupling system defined in claim 1, wherein said first pivot-defining member comprises a hub securely engaged with the mounting assembly by bolt means and incorporating a smoothly rounded outer peripheral surface.

7. The breakaway gate arm coupling system defined in claim 6, wherein said second pivot-defining member formed on the pivot bar comprises an aperture extending through the pivot bar having a diameter greater than the diameter of the rounded hub, thereby assuring the smooth interengaged pivoting action therebetween.

8. The breakaway gate arm coupling system defined in claim 1, wherein said mounting assembly is further defined as comprising
  (d) a coupling gate securable directly to the support member of the gate arm control system, and
  (e) bracket means mounted at one end thereof to the underside of the coupling plate with the other end thereof securable directly to the support member of the gate arm control system, thereby providing a mounting assembly capable of quick and easy installation directly to the support member of any gate arm control system.

9. The breakaway gate arm coupling system defined in claim 1, wherein the mounting assembly and the breakaway assembly are further defined as being formed from metal plate stock, capable of being bent and welded into the final assembly configuration.

10. The breakaway gate arm coupling system defined in claim 1, wherein said breakaway pivot assembly is further defined as comprising two side plates adapted for direct bolting engagement to opposed surfaces of the gate arm, with one edge of each side plate being directly secured to the side edges of the pivot bar.

11. The breakaway gate arm coupling system defined in claim 1, wherein said pivot bar must arcuately move through a distance of between about 15° and 25° before becoming dislodged from the shelf portions of the mounting assembly and being free to fall away from the mounting assembly.

12. The breakaway coupling system defined in claim 1, for use with fiberglass gate arms, the coupling system further comprising (D) a gate arm extender
  (a) comprising an elongated, hollow, aluminum tube adapted for receiving and securely engaging at a first end thereof the butt end of the fiberglass gate arm, and
  (b) securely mountable at its second end with the breakaway pivot assembly, thereby providing a gate arm stiffener and extender, assuring secure supporting maintenance of the lightweight fiberglass gate arm, while also preventing conductive contact with overhead wires.

* * * * *